US009861222B2

(12) United States Patent
Bauer et al.

(10) Patent No.: US 9,861,222 B2
(45) Date of Patent: Jan. 9, 2018

(54) HANGABLE APPARATUS AND SYSTEMS AND METHODS THEREFOR

(71) Applicant: Medline Industries, Inc., Mundelein, IL (US)

(72) Inventors: Lisa Bauer, Buffalo Grove, IL (US); Erin Jenkins, Cary, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 14/549,393

(22) Filed: Nov. 20, 2014

(65) Prior Publication Data

US 2015/0136339 A1 May 21, 2015

Related U.S. Application Data

(60) Provisional application No. 61/907,306, filed on Nov. 21, 2013.

(51) Int. Cl.
*A47H 13/02* (2006.01)
*A47H 13/04* (2006.01)
*A47H 1/142* (2006.01)

(52) U.S. Cl.
CPC ..... *A47H 13/04* (2013.01); *A47H 1/142* (2013.01)

(58) Field of Classification Search
CPC ..... A47H 13/04; A47H 1/142; A47H 13/16; A47H 15/04; A47H 15/02; A47H 2015/005; A47H 13/14; F16M 13/02; F16B 45/00
USPC ..... 160/DIG. 6, 330, 348; 248/301; D8/373; D6/575, 580; 206/298, 289
See application file for complete search history.

(56) References Cited

U.S. PATENT DOCUMENTS 2,093,269 A * 9/1937 Geller ..... A47H 23/08 160/124
2,188,163 A 1/1940 Sherman
2,386,603 A * 10/1945 Glaser ..... A47G 25/36 223/87
2,831,538 A 4/1958 Lishman
(Continued)

FOREIGN PATENT DOCUMENTS

CA 2485364 A1 * 11/2003
CN 100384356 11/2013
(Continued)

OTHER PUBLICATIONS

2-Ply Tissue Drape Sheets by Medline; Medline Catalog; http://www.medline.com/catalog/catalog/jsp; Unknown publication date but believe to be prior to present application filing date,.
(Continued)

*Primary Examiner* — Blair M Johnson
(74) *Attorney, Agent, or Firm* — Philip H. Burrus, IV

(57) ABSTRACT

A hanger (100) for a hanging item (1400) is provided. The hanger can define an aperture (102). The aperture can include a split rotated concave cardioid upper contour (104). The split rotated concave cardioid upper contour can include a first portion (105) and a second portion (106). The first portion and the second portion can be separated by an inverted convex cardioid (109). The inverted convex cardioid can be suspended into the aperture by two concave sidewalls (112,113). The aperture can include an intersecting concave lower contour (114) comprising a cusp (117).

20 Claims, 14 Drawing Sheets

(56) References Cited

U.S. PATENT DOCUMENTS

| | | | | |
|---|---|---|---|---|
| 3,032,242 | A * | 5/1962 | Roberts | A47G 25/743 206/806 |
| 3,321,003 | A | 5/1967 | Boerner | |
| 5,186,232 | A | 2/1993 | Zahner | |
| 6,494,248 | B1 | 12/2002 | Zahner | |
| 6,866,082 | B1 | 3/2005 | Zahner | |
| 6,935,402 | B2 | 8/2005 | Zahner | |
| 7,028,960 | B2 | 4/2006 | Goldstein | |
| 7,137,171 | B2 | 11/2006 | Meech et al. | |
| 7,296,609 | B2 | 11/2007 | Zahner | |
| 7,370,839 | B2 | 5/2008 | Putman | |
| 8,235,088 | B2 | 8/2012 | Zahner | |
| D668,091 | S | 10/2012 | Zahner | |
| D669,721 | S | 10/2012 | Zahner | |
| 8,408,275 | B2 | 4/2013 | DeWees et al. | |
| 2005/0022950 | A1 | 2/2005 | Putman | |
| 2007/0246174 | A1* | 10/2007 | Barrese | A47H 1/02 160/330 |
| 2008/0178423 | A1* | 7/2008 | Patel | A47H 13/00 16/87.2 |
| 2008/0202710 | A1 | 8/2008 | Zahner | |
| 2009/0050497 | A1* | 2/2009 | Chang | A47F 7/12 206/292 |
| 2010/0319858 | A1* | 12/2010 | Freedland | A47H 1/02 160/127 |
| 2012/0000616 | A1 | 1/2012 | DeWees et al. | |
| 2012/0018106 | A1* | 1/2012 | Robledo | A47H 1/04 160/330 |

FOREIGN PATENT DOCUMENTS

| | | | |
|---|---|---|---|
| DE | 3526744 | C1 * | 1/1987 |
| DE | 202013000922 | U1 * | 6/2013 |
| EP | 1894500 | A1 * | 3/2008 |
| GB | 2458075 | | 7/2011 |
| WO | WO-2004/058015 | | 7/2004 |
| WO | WO-2008/076260 | | 6/2008 |
| WO | WO 2014/117928 | * | 8/2014 |

OTHER PUBLICATIONS

Minor Procedure Drapes by Busse Hospital; Medline Catalog; http://www.medline.com/catalog/catalog/jsp; Unknown publication date but believe to be prior to present application filing date,.

Sterile Fields Drapes by Busse Hospital; Medline Catalog; http://www.medline.com/catalog/catalog/jsp; Unknown publication date but believe to be prior to present application filing date,.

Tissue Drapes; Medline Catalog; http://www.medline.com/catalog/catalog/jsp; Unknown publication date but believe to be prior to present application filing date,.

Tissue/Poly Drapes by Busse Hospital; Medline Catalog; http://www.medline.com/catalog/catalog/jsp; Unknown publication date but believe to be prior to present application filing date,.

* cited by examiner

HANGABLE APPARATUS AND SYSTEMS AND METHODS THEREFOR

CROSS REFERENCE TO PRIOR APPLICATIONS

This application claims priority and benefit under 35 U.S.C. §119(e) from U.S. Provisional Application No. 61/907,306, filed Nov. 21, 2013, which is incorporated by reference for all purposes.

BACKGROUND

Technical Field

This disclosure relates generally to a hangable device, and more particularly to and item comprising a hanger.

Background Art

Hanging items are popular in homes and businesses. Hanging items include curtains, drapes, plants, art, and so forth. Hanging items typically include a hanger, a mount, and something suspended from the hanger. Using a plant as one example, the hanger may comprise a metal hook, with the plant suspended beneath the hook. A user may couple the hook to a loop, perhaps mounted on the ceiling, to hang the plant.

While there are a variety of types of hangers and types of hanging items, curtains provide special challenges for designers. This is especially true in medical or hospital environments. It is frequently the case that medical service providers employ curtains to separate patients, conceal medical procedures from view, and to segregate areas of operating rooms and care centers. It is advantageous to launder such curtains to prevent the curtains from acting as a vector to transfer pathogens and bacteria from one patient to the next. However, prior art curtains are difficult to remove from their mounting rods. The dismounting process is costly and labor intensive. Additionally, a most prior art medical curtains use metal hangers, the dismounting process is noisy and therefore aggravating to patients and medical practitioners. Consequently, few prior art curtains get laundered as frequently as they should.

It would be advantageous to have an improved hangable apparatus, suitable for use in curtain and drape systems, that is easier and quieter to dismount.

Figure 1:
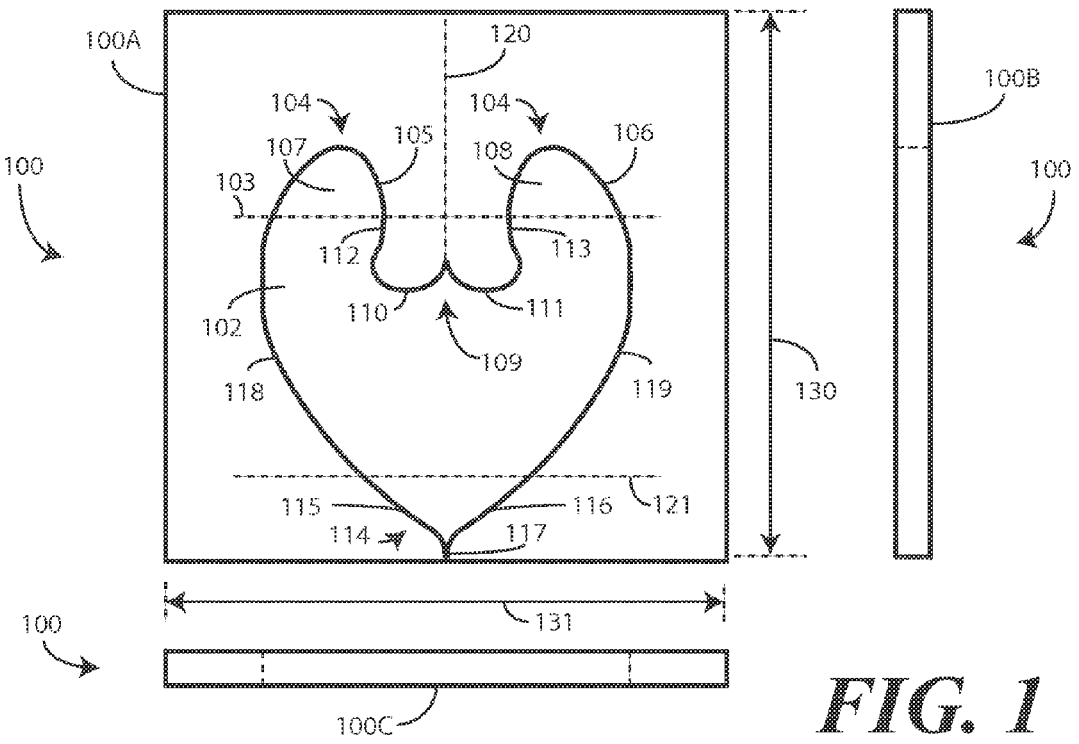
FIG. 1 illustrates one explanatory hanger in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. Apparatus components and method steps have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a hanger for an item. In one embodiment, the item to be hung is a curtain. Illustrating by example, for a hospital setting where infection control is an area of high concern, hangers configured in accordance with embodiments of the disclosure can be used to hang curtains between patients, procedures, areas, and so forth. Hangers configured in accordance with embodiments of the disclosure are easier to mount and dismount, thereby making it easier for health care practitioners to change and launder the curtains to ensure that bacteria and other pathogens are not readily transferred from patient to patient or from patient to health care practitioner.

Embodiments of the disclosure contemplate that it is very difficult to change prior art curtain systems designed for health care environments. The hangers are difficult to dismount from their tracks. Additionally, dust can collect in upwardly open tracks, thereby causing the hangers to get stuck within those tracks. Multiple people with ladders and specialized equipment are required to dismount the curtains, making changing or laundering the curtains a labor-intensive and costly endeavor. For this reason, curtains are rarely changed or washed. Experimental testing by the inventors reported that in some environments, it was considered fortunate if the curtains were changed three times a year. Advantageously, embodiments of the disclosure are quick and simple to mount and dismount, requiring only a single person for a few minutes to change the curtains. Accordingly, embodiments of the disclosure allow for more frequent changing and laundering of curtains, thereby promoting health and safety when embodiments of the disclosure are used in hospitals or other health care settings.

In addition to potentially serving as vectors for bacteria and other pathogens, prior art curtain hanging systems have other problems as well. As noted above, ladders are frequently required to mount or dismount prior art systems. Risk of injury increases when a worker steps on a ladder, as the worker may fall while mounting or dismounting the curtains. Advantageously, embodiments of the disclosure eliminate the need for a ladder, thereby making mounting and dismounting operations in accordance with embodiments of the disclosure safer.

In one embodiment, a hanger for an item comprises a uniquely configured aperture that facilitates simple mounting and dismounting of the hanger to a track. In one embodiment, the aperture comprises a split rotated concave cardioid upper contour. The split rotated concave cardioid upper contour can comprise a first portion and a second portion. In one embodiment, this first portion and second portion are separated by an inverted convex cardioid suspended into the aperture by sidewalls. In one embodiment, the sidewalls are concave relative to the aperture.

In one embodiment, the lower contour of the aperture comprises a cusp. The cusp can be oriented in the center of the lower contour of the aperture. A fold line can be defined between the center of the inverted convex cardioid to the cusp. The hanger can be folded along the fold line to transform the aperture into a track receiver comprising an open side formed along the fold line and a closed side formed by the outer contour of the aperture. The hanger can then be quickly and easily mounted on a track by placing the track receiver about a track such that the track seats within lobes formed by the split rotated concave cardioid upper contour.

Turning now to FIG. 1, illustrated therein is one explanatory hanger 100 configured in accordance with one or more embodiments of the disclosure. The hanger 100 is shown in front elevation view 100*a*, side elevation view 100*b*, and top plan view 100*c*. In one embodiment, the hanger 100 is manufactured from a woven mesh 101. For example, the woven mesh 101 can be a synthetic woven mesh, such as a woven mesh of nylon, polyester, plastic, or other synthetic fibers. In one embodiment, the woven mesh 101 is about three inches wide, which is from top to bottom as viewed in FIG. 1.

In one or more embodiments, the woven mesh 101 is configured to be launderable. Accordingly, when an item, such as a curtain or other item, is attached to the hanger 100, the entire assembly can be placed into a washing machine for laundering. Employing a woven mesh 101 as the hanger material advantageously allows the hanger to be used with curtains in a hospital or other medical environment, as the woven mesh 101 and curtain coupled thereto can be quickly and easily washed in a single operation.

As shown in FIG. 1, the hanger 100 defines an aperture 102. The aperture 102 includes various contours configured to facilitate easy mounting and dismounting of the hanger 100 to a track. The hanger 100 can be configured in a variety of sizes. For example, the length 130 and width 131 of the hanger can be between two and six inches in one or more embodiments. These dimensions are illustrative only, as others will be obvious to those of ordinary skill in the art having the benefit of this disclosure.

In the illustrative embodiment of FIG. 1, five primary contours are shown. Beginning at the top of the aperture 102, a split rotated concave cardioid upper contour 104 is present above delineation 103. The split rotated concave cardioid upper contour 104 is "split" because it includes a first portion 105 and a second portion 106 that are separated, rather than being connected as would be the case in a traditional cardioid. The first portion 105 and the second portion 106 of the split rotated concave cardioid upper contour 104 are "concave" because each defines a concave lobe 107,108 relative to the aperture 102. The concave lobes 107,108 are complementary to each other in shape in this embodiment. Said differently, each upper concave lobe, e.g., lobe 107, comprises and/or defines a contour of complementary to the other upper concave lobe, e.g., lobe 108, in this embodiment.

Use of the split rotated concave cardioid upper contour 104 is advantageous in many applications because it facilitates quick and simple mounting and dismounting of the hanger 100 from a track. However, it will be obvious to those of ordinary skill in the art having the benefit of this disclosure that a split rotated concave cardioid is but one shape suitable for the upper contour of the aperture. Segmented linear contours could be used as well. For example, the first portion 105 and the second portion 106 could be triangular, rectangular, multi-segmented, or free form, instead of curved with the curve defined by the split rotated concave cardioid upper contour 104.

In this embodiment, the first portion 105 and the second portion 106 of the split rotated concave cardioid upper contour 104 are separated by an inverted convex cardioid 109 that extends inwardly into the aperture 102. The inverted convex cardioid 109 forms the second primary contour of the aperture 102 in this embodiment. The inverted convex cardioid 109 is "inverted" because its cardioidal lobes 110,111 are 180 degrees out of phase with those of the first portion 105 and the second portion 106 of the split rotated concave cardioid upper contour 104. The inverted convex cardioid 109 is "convex" because its cardioidal lobes 110,111 define convex surfaces relative to the interior of the aperture.

Use of the inverted convex cardioid 109 is advantageous in many applications because it provides a reliable retention device without interrupting the quick and simple mounting and dismounting capabilities of the hanger 100 from a track. However, it will be obvious to those of ordinary skill in the art having the benefit of this disclosure that an inverted convex cardioid is but one shape suitable for the second primary contour of the aperture 102. Segmented linear contours could be used as well. For example, the cardioidal lobes 110,111 could be triangular, rectangular, multi-segmented, or free form, instead of curved with the curve defined by the inverted convex cardioid 109.

In one embodiment, the inverted convex cardioid 109 is suspended into the aperture 102 by two sidewalls 112,113. The two sidewalls 112,113 define the third primary contour of the aperture 102. In this illustrative embodiment, the two sidewalls 112,113 are concave relative to an interior of the aperture 102. In another embodiment, the two sidewalls 112,113 are substantially straight. In yet another embodiment, the two sidewalls 112, 113 comprise free-form contours that correspond to the outer surface of a track to which the hanger 100 is mounted. Other shapes for the two sidewalls 112,113 will be obvious to those of ordinary skill in the art having the benefit of this disclosure.

Figure 2:
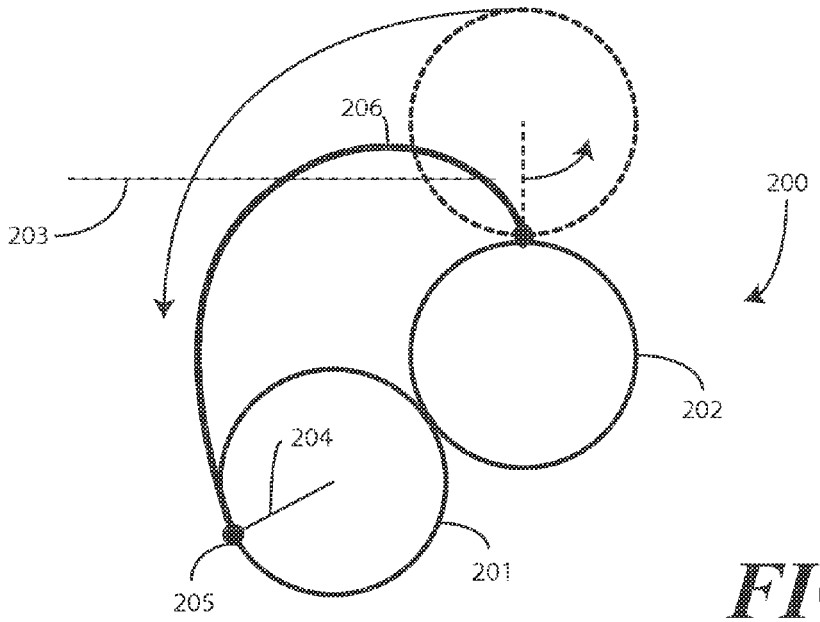
FIG. 2 illustrates an explanatory method of defining a cardioid in accordance with one or more embodiments of the disclosure.

Turning briefly to FIG. 2, illustrated therein is a method 200 of generating a cardioid for use as either the first portion (105) and the second portion (106) of the split rotated concave cardioid upper contour (104), or alternatively to generate the cardioidal lobes (110,111) of the inverted convex cardioid (109) in accordance with embodiments of the disclosure. In traditional cardioids, a circle 201 of fixed radius 204 is rotated about another circle 202, with a point 205 at the intersection of the fixed radius 204 drawing the cardioid 206. A bisecting line 203 can then cut the cardioid 206 to form either the first portion (105) and the second portion (106) of the split rotated concave cardioid upper contour (104), or alternatively the cardioidal lobes (110,111) of the inverted convex cardioid (109).

While this is one method 200 of generating a cardioid for use as either the first portion (105) and the second portion (106) of the split rotated concave cardioid upper contour (104), or alternatively to generate the cardioidal lobes (110, 111) of the inverted convex cardioid (109), in other embodiments, the radius of either circle 201 or circle 202 can vary in accordance with a predefined function as circle 201 rotates about circle 202. For example, either radius can vary in accordance with a linear function, a non-linear function, a polar equation based upon rotation of circle 201 about circle 202, or by parametric equations varying the radii of both circle 201 and circle 202 together. Accordingly, when radii of circle 201 and circle 202 vary, the contours of either the first portion (105) and the second portion (106) of the split rotated concave cardioid upper contour (104), or alternatively the cardioidal lobes (110,111) of the inverted convex cardioid (109), can take a variety of slopes there along as desired by a particular track design or application.

Turning now back to FIG. 1, the bottom of the aperture 102 is defined by an intersecting concave lower contour 114. The intersecting concave lower contour 114 forms the fourth primary contour of the aperture 102 in this embodiment. The intersecting concave lower contour 114 is "intersecting" because a first side 115 and a second side 116 intersect in the middle of the intersecting concave lower contour 114. The intersecting concave lower contour 114 is "concave" because it defines a concave contour relative to the interior of the aperture 102.

In this illustrative embodiment, the intersecting concave lower contour 114 comprises a cusp 117. The cusp 117 of this illustrative embodiment defines a downwardly directed point at the base of the aperture 102. Inclusion of a cusp 117 is optional. In other embodiments the first side 115 and the second side 116 of the intersecting concave lower contour 114 will define a smooth contour at the base of the aperture 102. Other intersecting contours at the base of the aperture 102 will be obvious to those of ordinary skill in the art having the benefit of this disclosure.

The fifth primary contour is defined by the first side contour 118 and the second side contour 119. In this embodiment, each of the first side contour 118 and the second side contour 119 is a concave contour disposed between delineation 103 and delineation 121. In other embodiments, the first side contour 118 and the second side contour 119 can be straight. In other embodiments, the first side contour 118 and the second side contour 119 are convex, or take free-form shapes corresponding to a track to which the hanger 100 will be attached. In one embodiment, the first side contour 118 and the second side contour 119 begin farther apart at delineation 103 and terminate closer together at delineation 121.

Figure 3:
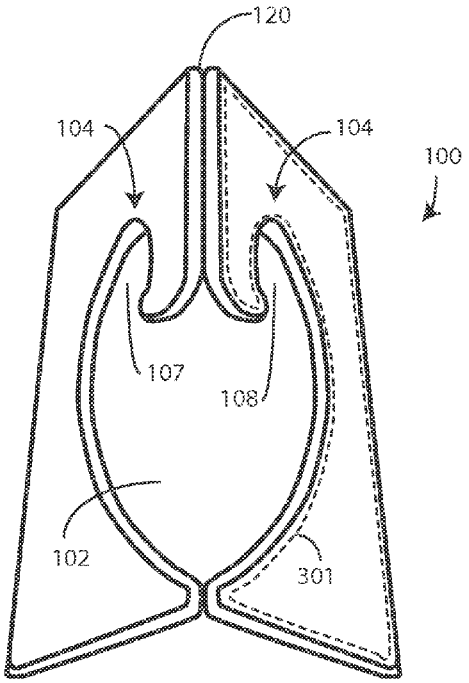
FIG. 3 illustrates one explanatory folded hanger in accordance with one or more embodiments of the disclosure.

The hanger 100 is configured to fold in one or more embodiments. Illustrating by example, the hanger 100 of FIG. 1 comprises a fold line 120 running from a center of the inverted convex cardioid 109 to the cusp 117. Turning to FIG. 3, illustrated therein is the hanger 100 after being partially folded about the fold line 120. As shown in FIG. 3, the hanger 100 can be folded along the fold line 120 to transform the aperture 102 into a track receiver comprising an open side formed along the fold line and a closed side formed by the outer contour of the aperture 102. The hanger 100 can then be quickly and easily mounted on a track by placing the track receiver about a track such that the track seats within lobes 107,108 formed by the split rotated concave cardioid upper contour 104. The track receiver will be shown in more detail below with reference to FIG. 4.

Figure 4:
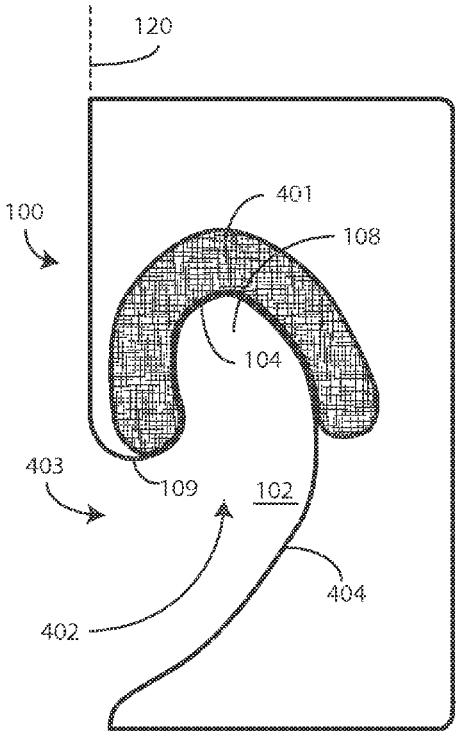
FIG. 4 illustrates another explanatory folded hanger in accordance with one or more embodiments of the disclosure.

In one or more embodiments, a reinforcing device can be added to the hanger 100 to stiffen the hanger 100 and/or reinforce the perimeter of the aperture 102. The use of a reinforcing device is optional, as in one or more embodiments no reinforcing device is required to stiffen the hanger 100 and/or reinforce the perimeter of the aperture 102 due to the natural stiffness of the hanger material. For example, in FIG. 3 stitching 301 has been disposed along a perimeter of the aperture 102. Turning to FIG. 4, illustrated therein is a hanger 100 to which an optional rigid reinforcing device 401 is attached. In the illustrative embodiment of FIG. 4, the optional rigid reinforcing device 401 is disposed about at least a portion of the split rotated concave cardioid upper contour 104. In one embodiment, the rigid optional reinforcing device 401 comprises a plastic device that is stitched, adhesively attached, or otherwise bonded to the hanger 100.

In the view of FIG. 4, the track receiver 402 formed when the hanger 100 is folded along the fold line 120 can more readily be seen. As noted above, the hanger 100 can be folded along the fold line 120 to transform the aperture 102 into a track receiver 402. In one embodiment, the width of the inverted convex cardioid is sufficiently wide as to move a center of gravity of the hanger 100 and/or the hanger 100 and a hanging item suspended by the hanger to be beneath an apex of the lobe 108 created by the split rotated concave cardioid upper contour 104.

In this embodiment, the track receiver 402 comprises an open side 403 formed along the fold line 120. The track receiver 402 also comprises a closed side 404 formed by the outer contour of the aperture 102. The hanger 100, when either partially or fully folded about the fold line 120, can then be quickly and easily mounted on a track by placing the track receiver 402 about a track such that the track seats within lobes 108 formed by the split rotated concave cardioid upper contour 104. This mounting will be shown in more detail with reference to FIGS. 11-13 below.

While an optional rigid reinforcing device 401 is used in FIG. 4 and optional stitching (301) in FIG. 3, it should be noted that these different reinforcing devices can be used in combination as well. Additionally, other reinforcing devices will be obvious to those of ordinary skill in the art having the benefit of this disclosure. As one example, the hanger 100 could be dipped into a resin to reinforce the aperture 102 as well.

Figure 5:
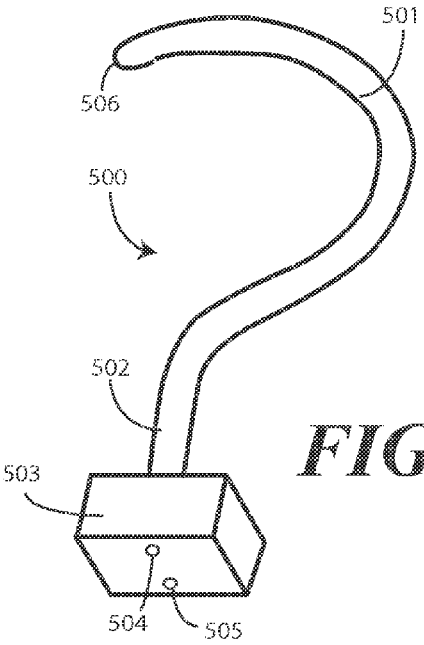
FIG. 5 illustrates one explanatory track hanger in accordance with one or more embodiments of the disclosure.

Turning now to FIG. 5, illustrated therein is one explanatory track hanger 500 configured in accordance with one or more embodiments. In one embodiment, the track hanger 500 is to suspend a track from a surface such as a wall or ceiling. This illustrative track hanger 500 includes a hook 501, an extension 502, and a base member 503. The base member 503 can optionally include one or more apertures 504,505 through which screws or other fasteners may be inserted to attach the base member 503 to a ceiling or other flat surface from which something is to be hung.

In one embodiment, the track hanger 500 is a unitary element, with each of the hook, extension 502, and base member 503 being formed as a single, integral unit. For example, in one embodiment the track hanger 500 is manufactured from a thermoplastic material by way of an injection molding process. The track hanger 500 can be manufactured from nylon, styrene, ABS, polycarbonate, or polycarbonate-ABS, PMMA, PVC, or other polyamide-based thermoplastics in one embodiment.

The extension 502 can be of varying lengths so as to lower the track, which will be attached to the tip 506 of the track hanger 500 in one embodiment, from a ceiling or other surface. Additionally, the diameter of the hook 501 can be altered to move the tip 506 farther from the ceiling as well. Of course, combinations of extending the extension 502 and increasing the diameter of the hook 501 can be used. By lowering the track from the ceiling by increasing the diameter of the hook 501, lengthening the extension 502, or combinations thereof, a user can more easily attach the hanger to the track, thereby simplifying the mounting and dismounting process. Making hanging and taking down processes simpler fosters more frequent laundering or curtains attached to hangers configured in accordance with embodiments of the disclosure, thereby creating a cleaner environment. In one embodiment, the track is lowered from the ceiling by about four inches by any of increasing the diameter of the hook 501, lengthening the extension 502, or combinations thereof.

Figure 6:
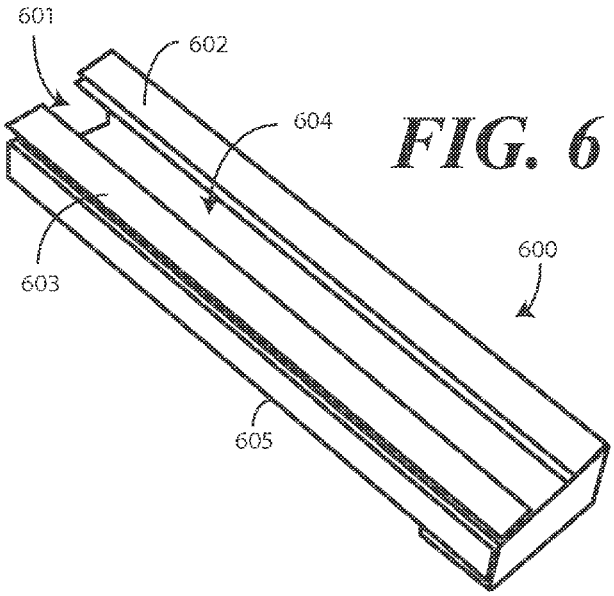
FIG. 6 illustrates a mounting rail for a track hanger in accordance with one or more embodiments of the disclosure.

In one or more embodiments, rather than employing the apertures 504,505 to attach the track hanger 500 to a ceiling or other surface, a track can be supplied into which the track hanger 500 may be inserted. Turning now to FIG. 6, illustrated therein is one example of such a track 600.

In one embodiment, the track 600 is manufactured from metal. In one embodiment, the track has its base 605 attached directly to a flat surface, such as a wall or ceiling. In another embodiment, the base 605 of the track is recessed into a wall or ceiling such that the rails 602,603 of the track 600 are flush with the surface.

The track 600 includes at least one receiving opening 601 disposed at an end. The base member (503) of the track hanger (500) can be inserted into the receiving opening 601 to attach the track hanger (500) to the track 600. Two rails 602,603 are separated by a slot 604. When the base member (503) of the track hanger (500) is inserted into the receiving opening 601 of the track 600, the extension (502) can pass through the slot 604. Accordingly, a user can move the track hanger (500) to any desired location along the track 600. Additionally, the user is free to position track hangers at any desired frequency, i.e., the user may space track hangers apart at any desired distance.

Figure 7:
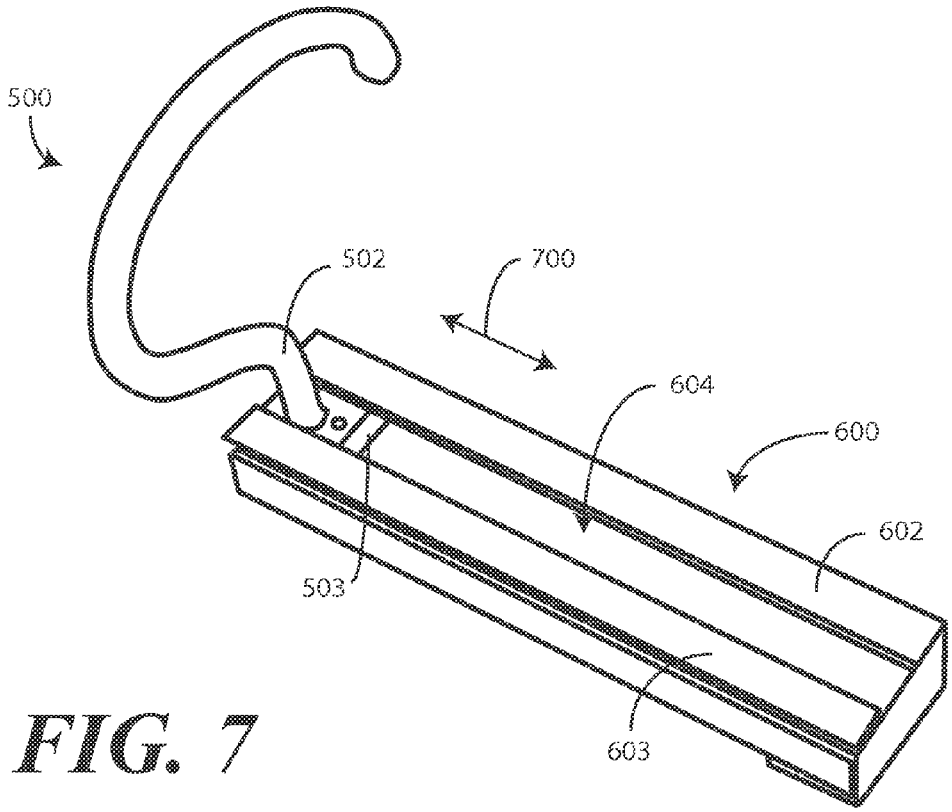
FIGS. 7-8 illustrate one explanatory track hanger seated within a mounting rail in accordance with one or more embodiments of the disclosure.
Figure 8:
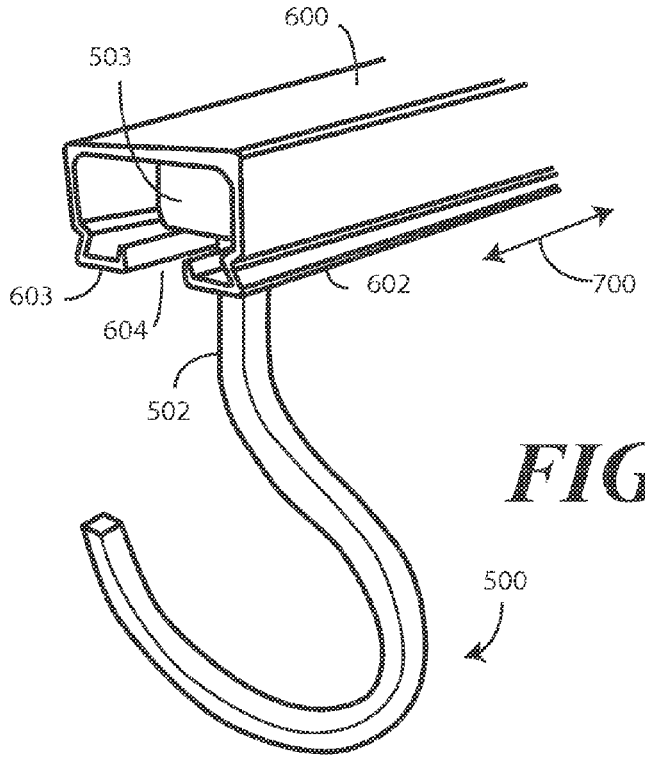

Turning now to FIGS. 7 and 8, illustrated therein is the track hanger 500 inserted into the track 600. As previously described, the extension 502 extends through the slot 604 while the base member 503 of the track hanger 500 is retained within the track 600 by the rails 602,603. Accordingly, the user simply slides 700 the track hanger 500 along the track 600 to a desired location. Additionally, the user can place as few or as many track hangers within the track 600 as desired, spacing them apart at any distance they choose. This "moveability" allows the track hangers to be repositioned and reconfigured within the track 600 at will.

Figure 9:
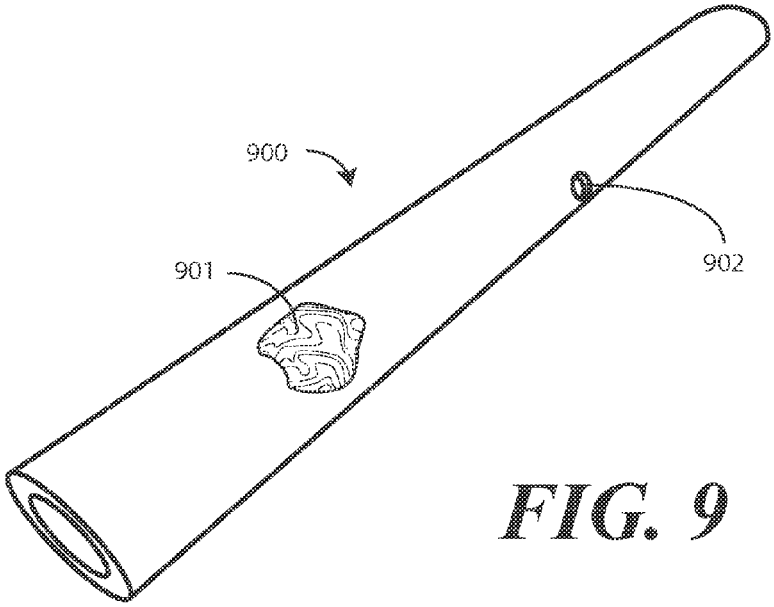
FIG. 9 illustrates one explanatory track in accordance with one or more embodiments of the disclosure.

Turning now to FIG. 9, illustrated therein is one explanatory track 900 configured in accordance with one or more embodiments of the disclosure. In this illustrative embodiment, the track 900 comprises a tube that is generally round in cross section. In one embodiment, the track 900 is flexible so that it can be shaped into different contours when attached to a track hanger (500). For example, in one embodiment the track 900 is manufactured from plastic. One suitable plastic for the track 900 is polyethylene, although other flexible materials will be obvious to those of ordinary skill in the art having the benefit of this disclosure. In one embodiment, the track 900 is manufactured from an extrusion process.

Figure 16:
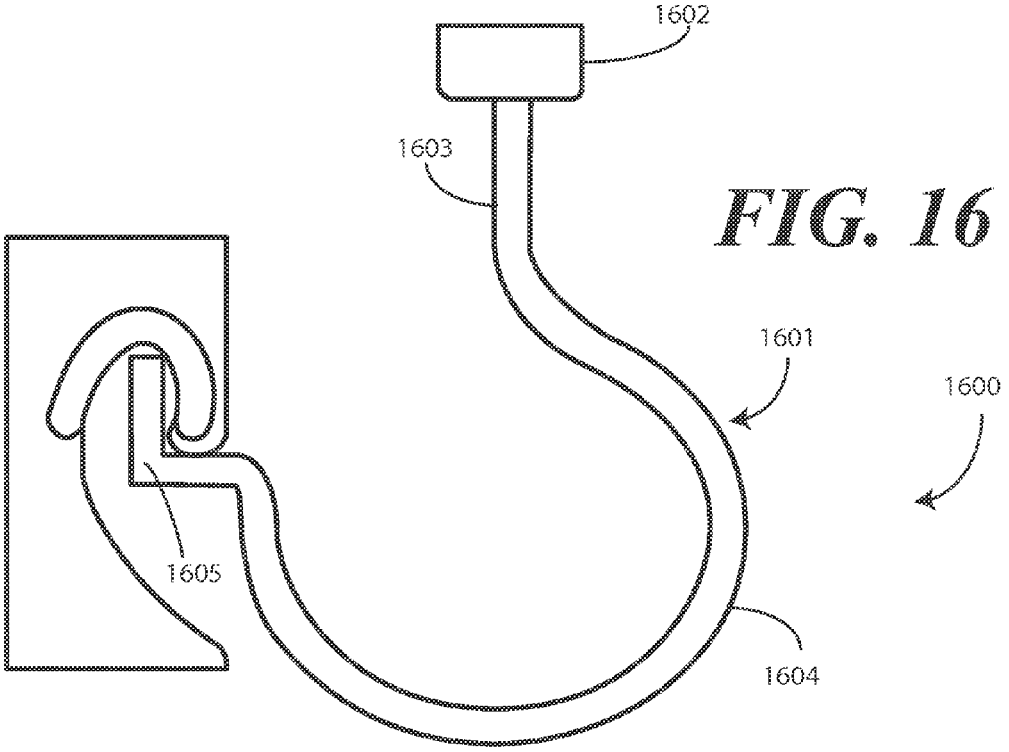
FIG. 16 illustrates an alternate hanging system in accordance with one or more embodiments of the disclosure.

In one embodiment, the track 900 is a continuous piece. In other embodiments, segments of different tracks can be aligned end-to-end to form a composite track. In one embodiment, the track 900 is malleable. While the cross section of the track 900 shown in FIG. 9 is generally circular, it should be noted that the cross section could take other shapes as well, such as ovular or flat. Some of these shapes will be shown below with reference to FIGS. 16 and 17.

In one embodiment the track 900 is configured so as to be easily cleaned. In one embodiment, the track 900 is manufactured so as to be light beige in color. In one embodiment, the track 900 is cut to predefined lengths, such as twenty-foot lengths. In one or more embodiments, the ends of the track 900 can be contoured for smooth interconnection to adjacent track segments.

In one embodiment, the track 900 comprises a coating 901. For example, in one embodiment the track 900 is coated with a silicon-based coating to allow hangers configured in accordance with one or more embodiments to more smoothly slide along the track 900. It should be noted that one primary advantage offered by embodiments of the disclosure is that hanging systems configured in accordance with embodiments of the disclosure are very, very quiet when in operation. For example, where the track 900 is manufactured from polyethylene and coated with silicon, and the hanger (100) is made from a woven polyester mesh, moving the hanger (100) along the track 900 is nearly a silent procedure. This is advantageous in hospitals and other medical environments where noise is problematic. Prior art hanging systems, which primarily include metal, are loud and intrusive. In one embodiment of the present disclosure, each of the track 900, the hanger (100), and any item attached thereto is made without any metal. This greatly reduces—if not eliminates—noise when the hangers are moved on the track 900.

A second advantage of not including metal in either the track 900 or the hanger (100) is that components of systems configured in accordance with various embodiments of the disclosure can be extremely light in weight. This enables the track 900 to easily be mounted on track hangers, and hangers attached to the track 900. The process can be accomplished by anyone, regardless of size or strength.

Figure 10:
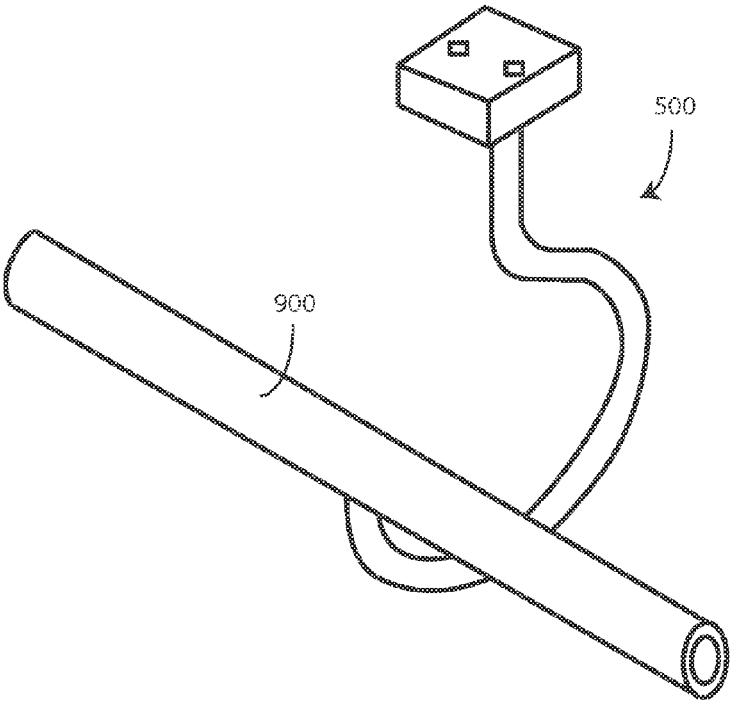
FIG. 10 illustrates one explanatory track system in accordance with one or more embodiments of the disclosure.

In one or more embodiments, one or more apertures 902 are disposed along the track 900. As will be shown in subsequent figures, the tip (506) of the hook (501) of a track hanger (500) can be inserted into the one or more apertures 902 to attach the track 900 to the track hanger (500). The one or more apertures 902 can be positioned at any desired location along the track 900 to facilitate attachment of track hangers at any desired point. In other embodiments, the track 900 may omit the one or more apertures 902. Where this occurs, the track material may be soft enough to allow the tip (506) of the hook (501) of a track hanger (500) to penetrate the track 900 to attach the track hanger (500) to the track 900. Turning now to FIG. 10, illustrated therein is a track hanger 500 having a track 900 attached thereto.

Figure 11:
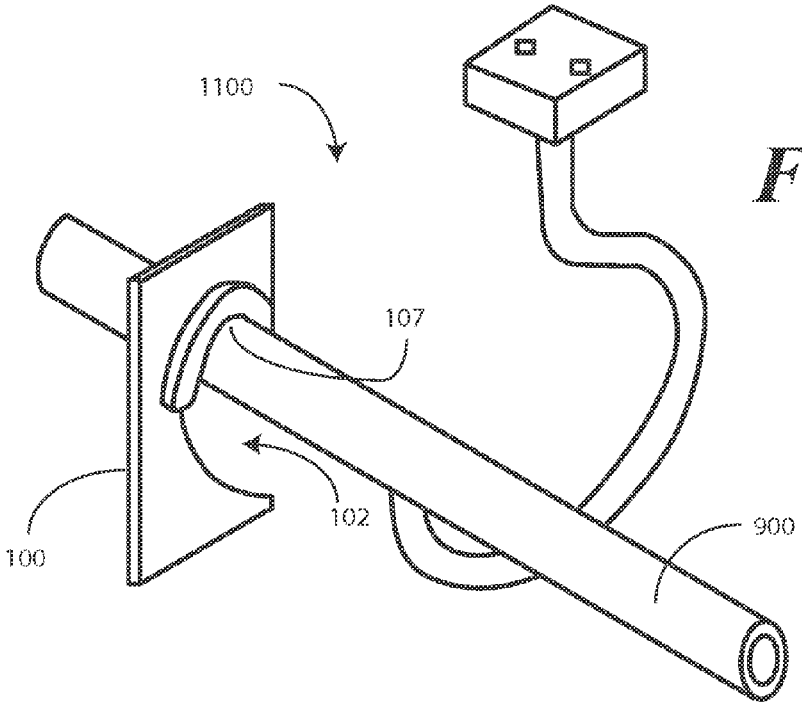
FIGS. 11-13 illustrate one explanatory hanger positioned on one explanatory track system configured in accordance with one or more embodiments of the disclosure.
Figure 12:
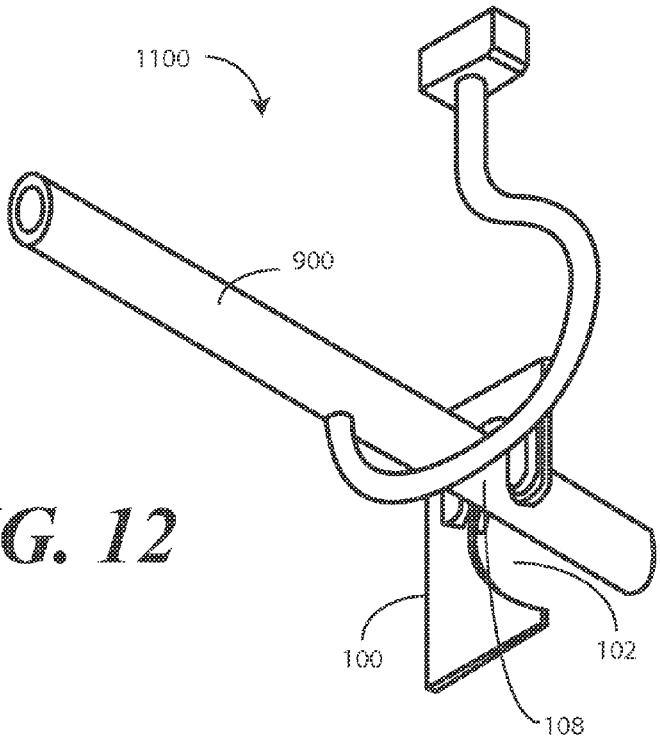
Figure 13:
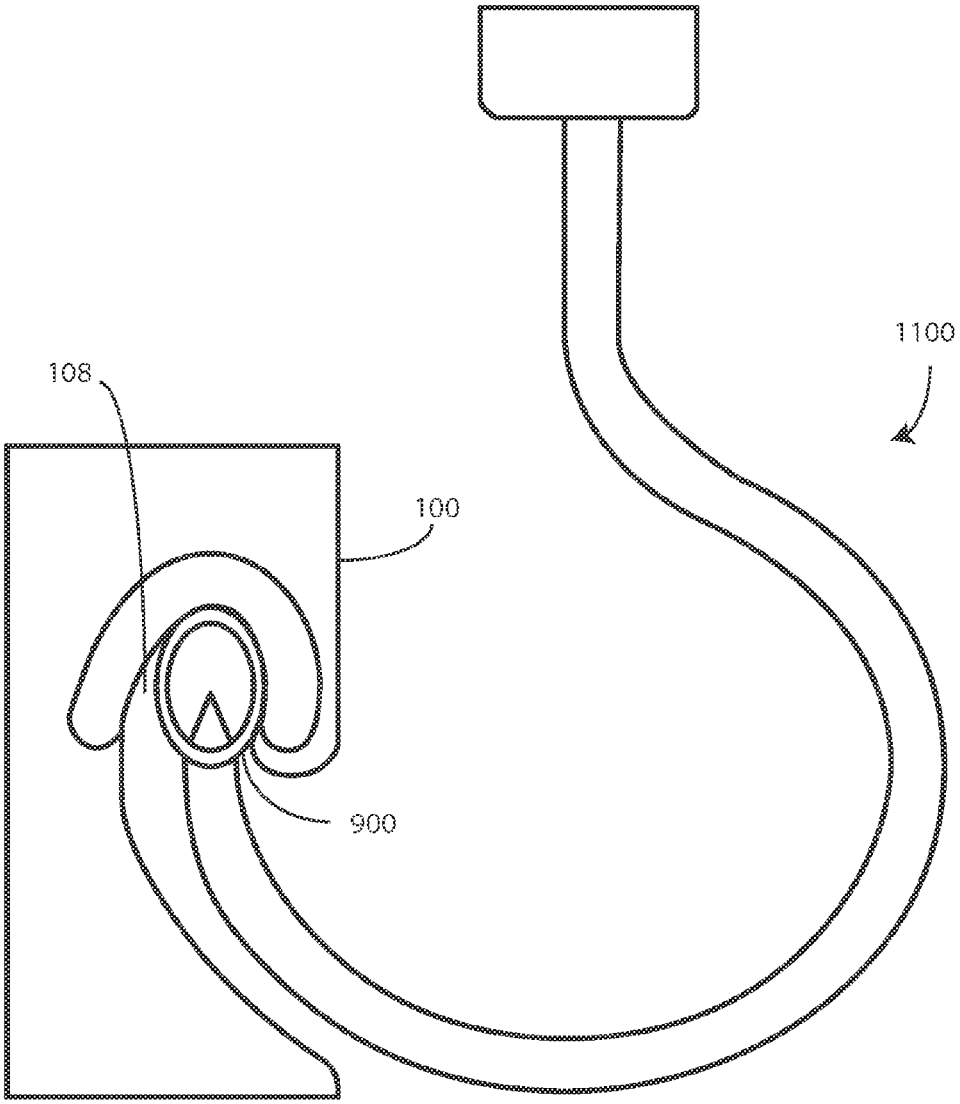

Once the track hanger 500 is either placed into a mounting track (600), or mounted directly to a wall or ceiling using screws or other fasteners placed through apertures (504,505) in the base member (503), the track 900 can be attached thereto to form a mounting system. After the mounting system is shaped as desired, one or more hangers having items hanging therefrom can be mounted on the track 900. Turning now to FIGS. 11-13, illustrated therein is a hanger 100 mounted on the track 900 in accordance with one or more embodiments.

Figure 14:
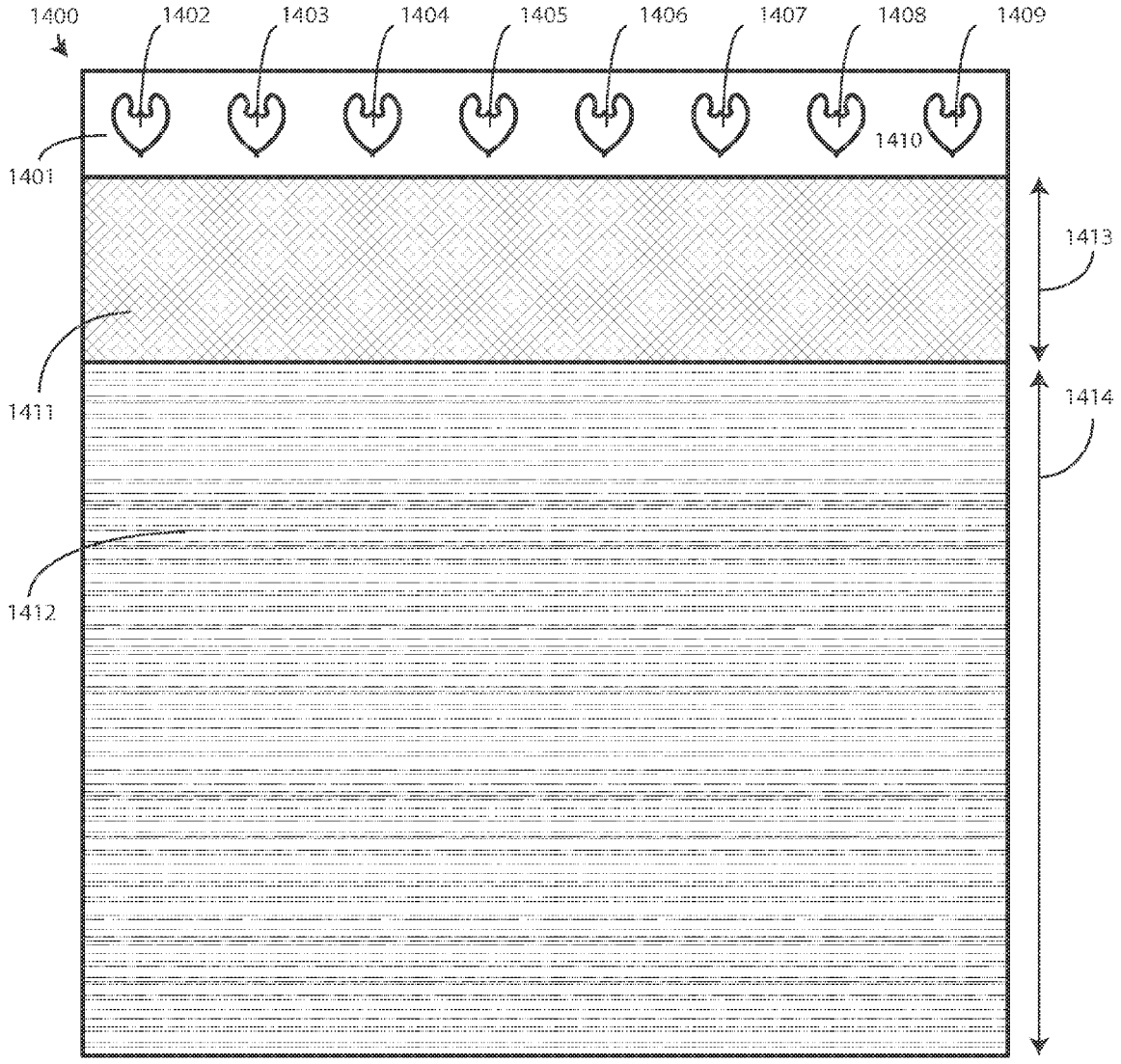
FIG. 14 illustrates one explanatory hangable item in accordance with one or more embodiments of the disclosure.
Figure 15:
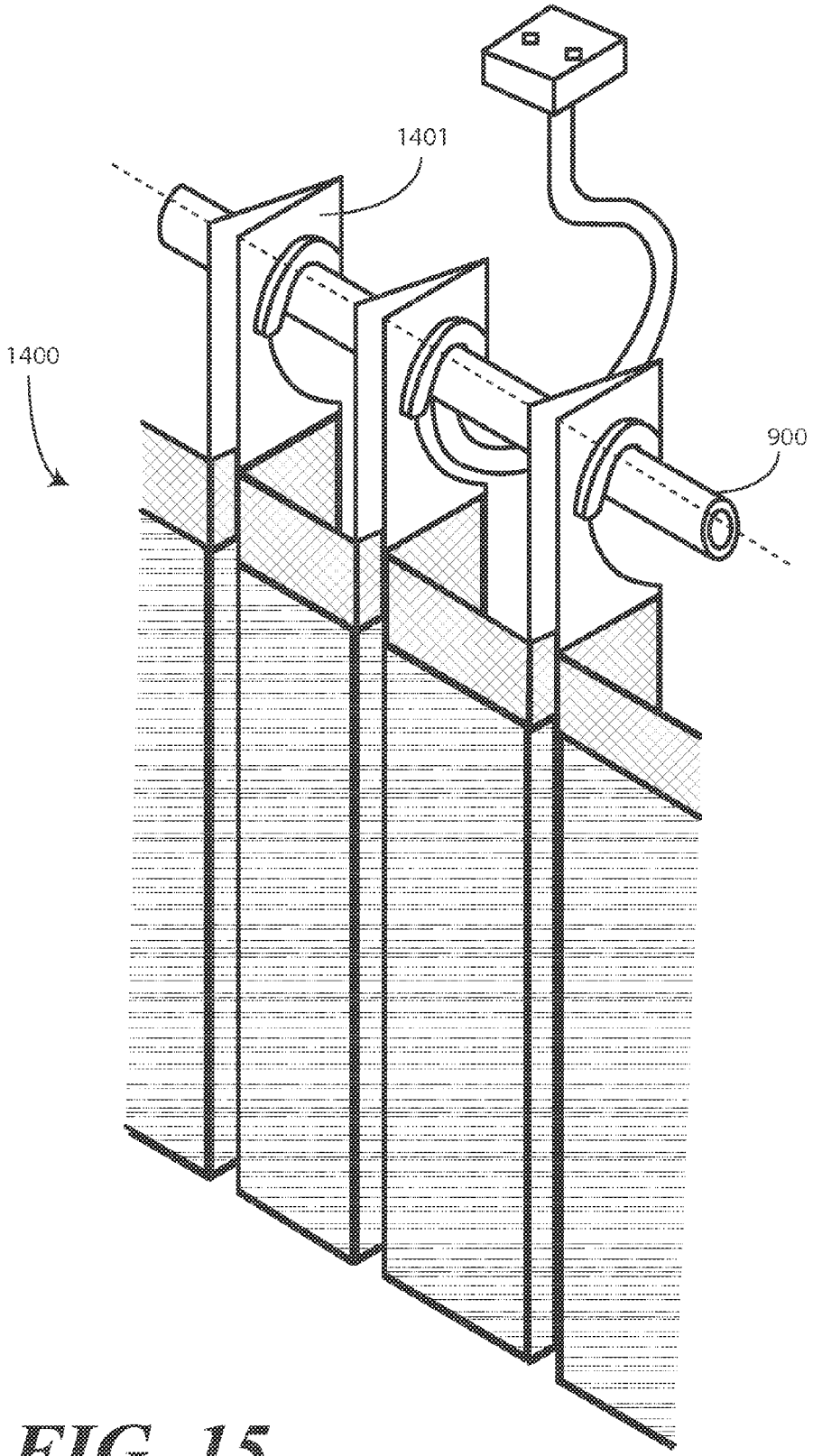
FIG. 15 illustrates one explanatory hanging system in accordance with one or more embodiments of the disclosure.

As shown in FIGS. 11-13, a system comprises a hanging apparatus 1100. In this illustrative embodiment, the hanging apparatus 1100 comprises a hanger 100 and a hanging item extending distally from the hanger 100 (the hanging apparatus is not shown in FIGS. 11-13 for clarity, but one example of which is shown in FIGS. 14-15). The hanger defines an aperture 102. As noted above, in one embodiment the aperture comprises a split rotated concave cardioid upper contour (104) bisected by an inverted convex cardioid (109) suspended into the aperture 102 and an intersecting concave lower contour (114) comprising a cusp (117). The aperture 102 is to fold along the inverted convex cardioid (109) to form a folded hanger. As shown in FIGS. 11-13, the track 900 fits within upper lobes 107,108 of the folded hanger defined by the split rotated concave cardioid upper contour (104) to hang from the track 900.

Turning now to FIG. 14, illustrated therein is one hanging item 1400 comprising a hanger 1401 that defines a plurality of apertures 1402, 1403, 1404, 1405, 1406, 1407, 1408, 1409 in accordance with one or more embodiments of the disclosure. The hanging item 1400 of FIG. 14 is a curtain. However, it will be obvious to those of ordinary skill in the art having the benefit of this disclosure that the hanging item 1400 can take other forms as well, including artwork, plants, animal or insect netting, waterproofing material, and so forth.

The hanger 1401 of this embodiment is a strip of woven mesh into which the apertures 1402, 1403, 1404, 1405, 1406, 1407, 1408, 1409 are cut with a hot knife or hot die. The curtain of this illustrative embodiment extends distally from a cusp side 1410 of the hanger 1401. This curtain comprises a porous mesh section 1411 and an opaque section 1412. The porous mesh section 1411 is disposed between the hanger 1401 and the opaque section 1412 in this embodiment. Such curtains are well suited for hospital and other medical environments because they allow air circulation through the porous mesh section 1411, while providing privacy and sound dampening at the opaque section 1412.

While this illustrative embodiment includes the porous mesh section 1411 and the opaque section 1412, it will be obvious to those of ordinary skill in the art having the benefit of this disclosure that the hanging item 1400 could be configured in other ways as well. For example, in another embodiment the hanging item 1400 is completely opaque, while in yet another embodiment the hanging item 1400 is complete porous mesh. In another embodiment, selective portions of the hanging item 1400 can be opaque, while other portions are porous mesh. In still other embodiments, one or both of the porous mesh or the opaque material can be substituted with transparent materials. These are examples of various hanging item configurations only.

In the illustrative embodiment, each aperture 1402, 1403, 1404, 1405, 1406, 1407, 1408, 1409 us separated between two and twenty inches. For example, in one embodiment each aperture 1402, 1403, 1404, 1405, 1406, 1407, 1408, 1409 is separated between ten and fifteen inches. In one embodiment, each aperture 1402, 1403, 1404, 1405, 1406, 1407, 1408, 1409 is separated about twelve and a half inches. In this illustrative embodiment, the porous mesh section 1411 has a length 1413 of between eighteen and twenty-two inches. For example, in one embodiment, the porous mesh section extends about nineteen inches in length 1413 beneath the hanger 1401. The length 1414 of the opaque section 1412 can be determined by the environment in which the hanging item 1400 is to be placed. In one embodiment, the length 1414 of the opaque section 1412 is a function of track separation from a ceiling and total ceiling height.

As with previous embodiments, each aperture 1402, 1403, 1404, 1405, 1406, 1407, 1408, 1409 is foldable along its vertical centerline to form a folded hanger. Once folded, the hanging item 1400 can be attached to a track by placing an open side of each aperture 1402, 1403, 1404, 1405, 1406, 1407, 1408, 1409 over the track to seat the track within the lobes defined by the split rotated concave cardioid upper contours. Turning now to FIG. 15, illustrated therein is such a system.

As shown in FIG. 15, each aperture (1402, 1403, 1404, 1405, 1406, 1407, 1408, 1409) has been folded so that an open side of the track receiver formed by folding each aperture (1402, 1403, 1404, 1405, 1406, 1407, 1408, 1409) can be placed on a track 900. The hanging item 1400 can quickly and easily be mounted or dismounted from the track 900 by simply lifting the hanging item 1400 off the track or setting it thereon. Additionally, by folding the hanging item in an accordion fold, the hanging item can be compressed such that each aperture (1402, 1403, 1404, 1405, 1406, 1407, 1408, 1409) of the hanger 1401 touches the next adjacent aperture (1402, 1403, 1404, 1405, 1406, 1407, 1408, 1409) so that the hanging item can easily be lifted and moved by a single user employing only their hands.

The system of FIG. 15 allows the hanging item 1400 to be quickly and simply mounted to, or dismounted from, the track 900. Moreover, as previously described, the track 900 itself is easy to mount and configure as desired. The system allows for smooth and quiet movement of the hanging item 1400. Additionally, the system is very aesthetically pleasing as well.

Figure 22:
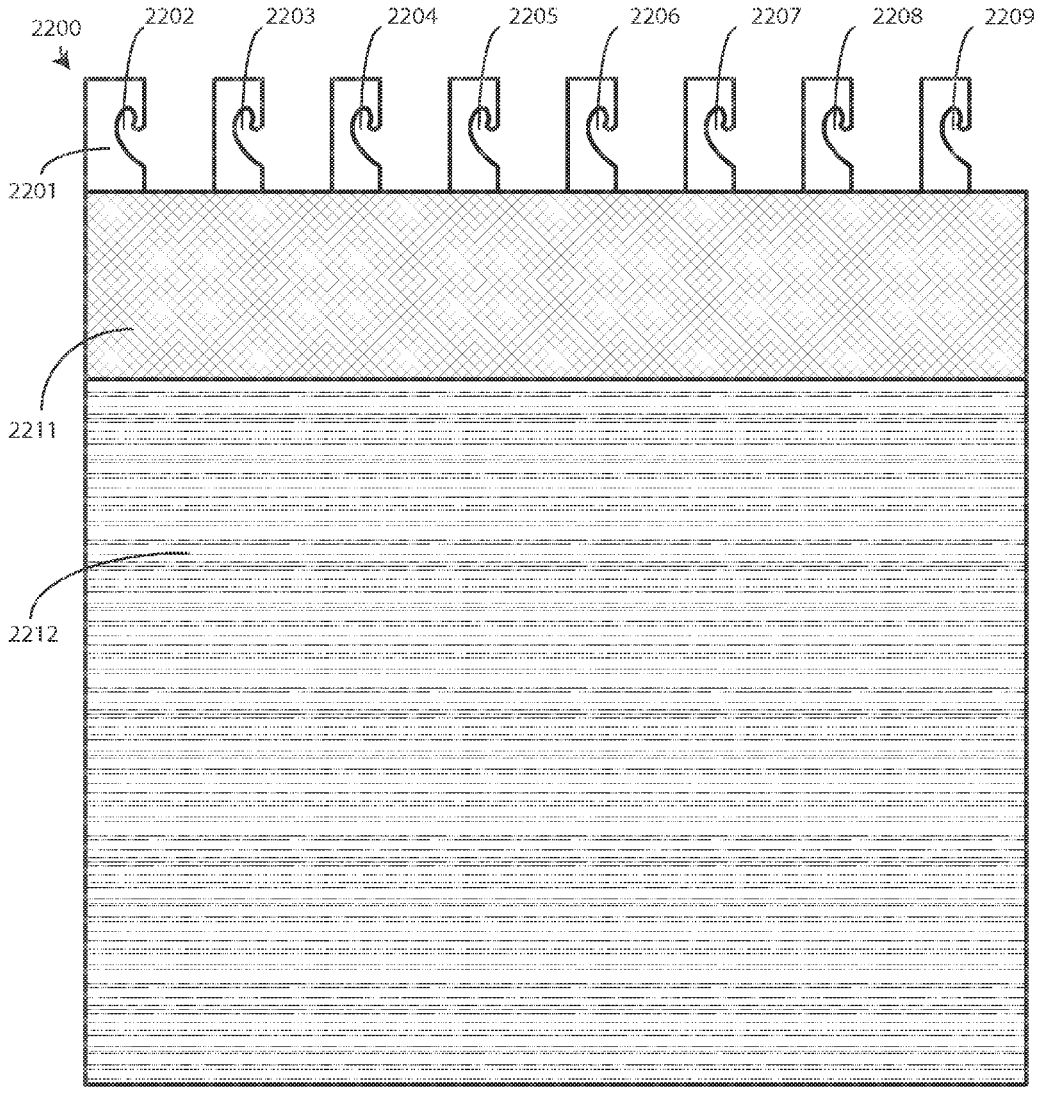
FIG. 22 illustrates one explanatory hanging item comprising a hanger that is segmented in accordance with one or more embodiments of the disclosure.
Figure 23:
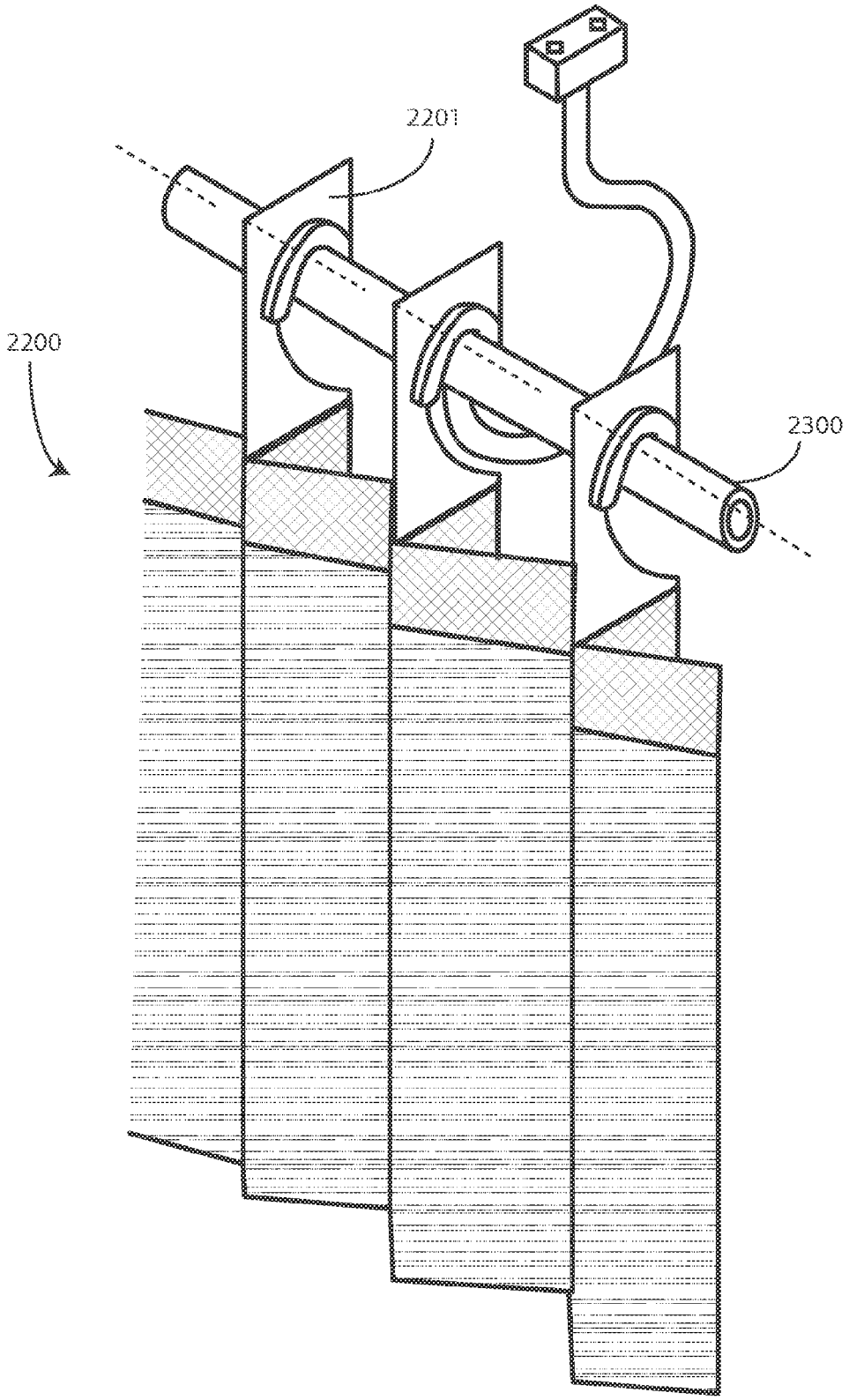
FIG. 23 illustrates an application for one explanatory hanging item in accordance with one or more embodiments of the disclosure.

To this point, the hanging item 1400 has been described as including woven mesh that is folded to form the split rotated concave cardioid upper contour. However, in one or more embodiments, the split rotated concave cardioid upper contour can be formed without folding when the aperture is open, i.e., such that each aperture (1402, 1403, 1404, 1405, 1406, 1407, 1408, 1409) of the hanger 1401 is cut in half and the woven mesh is segmented. Such an embodiment is shown in FIGS. 22-23. Turning briefly to these figures, this embodiment will be briefly described.

Beginning with FIG. 22, illustrated therein is one hanging item 2200 comprising a hanger 2201 that is segmented. Each segment defines a plurality of open apertures 2202, 223, 2204, 2205, 2206, 2207, 2208, 2209 in accordance with one or more embodiments of the disclosure. The hanging item 2200 of FIG. 22 is a curtain. However, it will be obvious to those of ordinary skill in the art having the benefit of this disclosure that the hanging item 2200 can take other forms as well, including artwork, plants, animal or insect netting, waterproofing material, and so forth.

The hanger 2201 of this embodiment is a plurality of segments of woven mesh into which the apertures 2202, 2203, 2204, 205, 2206, 2207, 2208, 2209 are cut with a hot knife or hot die. The apertures 2202, 2203, 2204, 205, 2206, 2207, 2208, 2209 are open along one side of each segment, i.e., the right side of each segment in FIG. 22, while the other side, i.e., the left side of each segment in FIG. 22, does not intersect the aperture. This curtain comprises a porous mesh section 2211 and an opaque section 2212. The porous mesh section 2211 is disposed between the hanger 2201 and the opaque section 2212 in this embodiment.

In the illustrative embodiment, each aperture 2202, 2203, 2204, 2205, 2206, 2207, 2208, 2209 us separated between two and twenty inches. For example, in one embodiment each aperture 2202, 2203, 2204, 2205, 2206, 2207, 2208, 2209 is separated between ten and fifteen inches. In one embodiment, each aperture 2202, 2203, 2204, 2205, 2206, 2207, 2208, 2209 is separated about twelve and a half inches In contrast to previous embodiments, each aperture 2202, 2203, 2204, 2205, 2206, 2207, 2208, 2209 need not be folded due to the fact that an entry into each aperture is available along one side of each hanger segment. Accordingly, without any folding, the hanging item 2200 can be attached to a track by placing an open side of each aperture 2202, 2203, 2204, 2205, 2206, 2207, 2208, 2209 over the track to seat the track within the lobes defined by the split rotated concave cardioid upper contours. Turning now to FIG. 23, illustrated therein is such a system.

As shown in FIG. 23, the open side of each aperture (2202, 2203, 2204, 2205, 2206, 2207, 2208, 2209) has been placed on a track 2300. The hanging item 2200 can quickly and easily be mounted or dismounted from the track 2300 by simply lifting the hanging item 2200 off the track or setting it thereon. Additionally, by folding the hanging item 2200 in an accordion fold, the hanging item can be compressed such that each aperture (2202, 2203, 2204, 2205, 2206, 2207, 2208, 2209) of the hanger 2201 touches the next adjacent aperture (2202, 2203, 2204, 2205, 2206, 2207, 2208, 2209) so that the hanging item can easily be lifted and moved by a single user employing only their hands.

Turning now to FIGS. 16-19, illustrated therein are various hanging apparatuses configured in accordance with one or more embodiments of the disclosure. Beginning with FIG. 16, the hanging apparatus 1600 comprises a track hanger 1601 that includes a base 1602, an extension 1603, and a hook 1604. A track 1605 is integrally formed with the hook 1604 and has a rectangular cross section. While integrating the track 1605 with the hook 1604 is one possible configuration, in other embodiments the track 1605 can be separable from the hook 1604 as previously described. Additionally, rather than having a rectangular cross section, the track 1605 can have a triangular or polygonal cross section as well.

Figure 17:
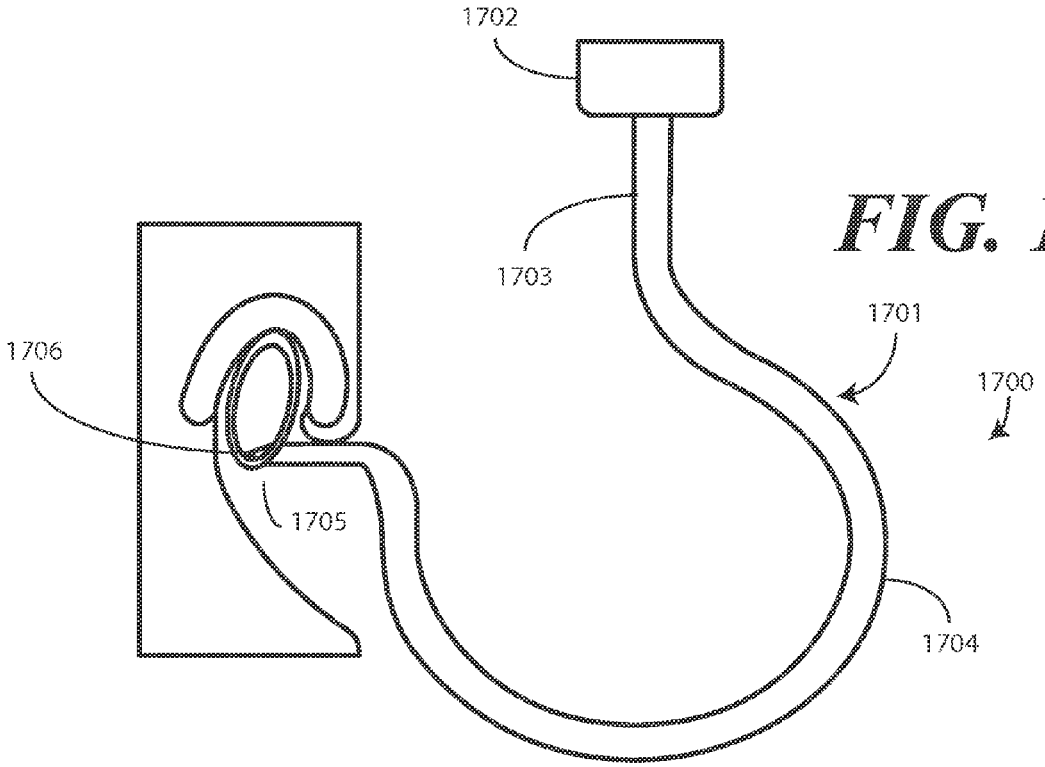
FIG. 17 illustrates an alternate hanging system in accordance with one or more embodiments of the disclosure.

Turning to FIG. 17, the hanging apparatus 1700 comprises a track hanger 1701 that includes a base 1702, an extension 1703, and a hook 1704. The hook connects into the side of a track 1705 having an ovular cross section. The track 1705 of FIG. 17 does not include apertures as did the track (900) of FIG. 9. Instead, the track 1705 is soft enough that the tip 1706 of the track hanger 1701 penetrates the side of the track 1705 to attach the track 1705 to the track hanger 1701. Additionally, in this illustrative embodiment, the track 1705 is oriented such that the major axis of the ovular cross section is non-vertical.

Figure 18:
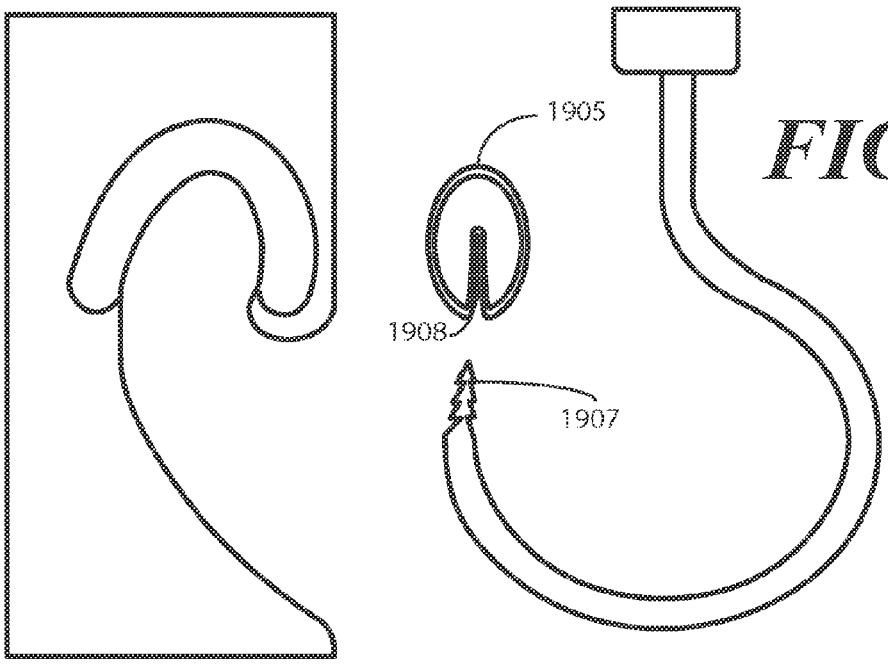
FIGS. 18-19 illustrate an alternate hanging system in accordance with one or more embodiments of the disclosure.
Figure 19:
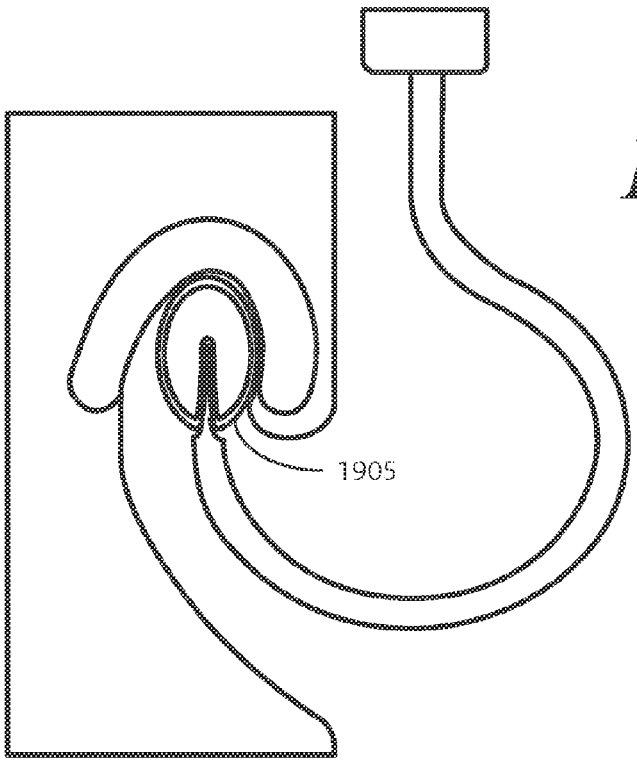

Turning now to FIGS. 18 and 19, illustrated therein is another hanging apparatus 1900. FIG. 18 illustrates an exploded view, while FIG. 19 illustrates an assembled view. The hanging apparatus 1900 comprises a track hanger 1901 that includes a base 1902, an extension 1903, and a hook 1904. The hook 1904 terminates in a barbed hook 1907 that facilitates one-way penetration of the barbed hook 1907 into the track 1905. Additionally, the track 1905 of this embodiment includes an inward slot 1908 into which the barbed hook 1907 is inserted.

Figure 20:
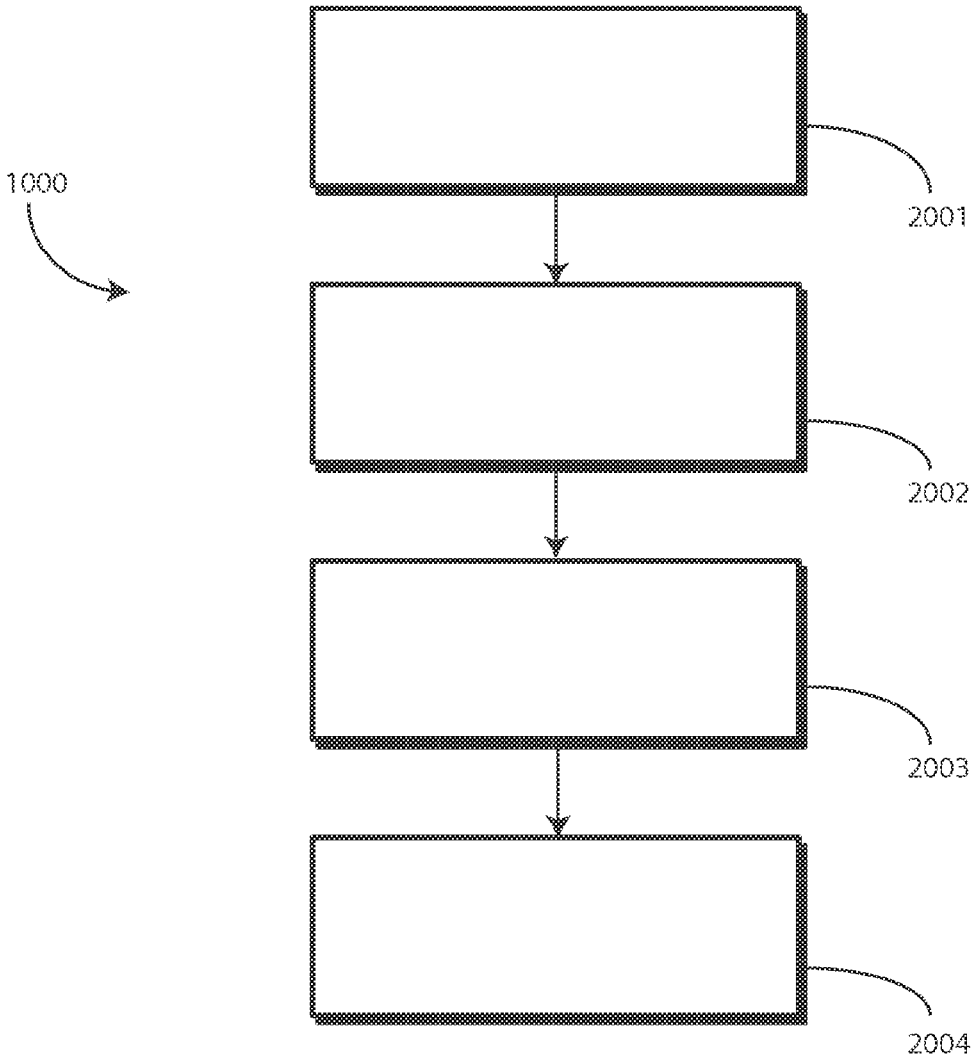
FIG. 20 illustrates an explanatory method in accordance with one or more embodiments of the disclosure.

Turning now to FIG. 20, illustrated therein is a method 2000 in accordance with one or more embodiments of the disclosure. The method 2000 can be used to manufacture one or more hangable systems configured in accordance with embodiments of the disclosure, as well as to mount a hanging item in accordance with one or more embodiments. Additionally, select steps of the method 2000 can be executed in reverse order to dismount the hanging item as well.

Beginning at step 2001, a hanger is provided for an item. At step 2001, the hanger is provided by placing apertures in the hanger. In one embodiment, each aperture comprises a split rotated concave upper cardioid contour bisected by an inverted convex cardioid extending into the aperture between portions of the split rotated concave cardioid contour.

At step 2002, an item attached to the hanger of step 2001 is provided. In one embodiment, the item extends distally from the hanger. Examples of items include curtains, dividers, artwork, plant baskets, and so forth.

At step 2003, each aperture is folded along a fold lien bisecting each aperture. The folding transforms each aperture into a track receiver. At step 2004, the item is mounted on a track by placing the track into one or more lobes formed by the split rotated concave upper cardioid contour. Step 2004 can be reversed to dismount the item from the track.

Figure 21:
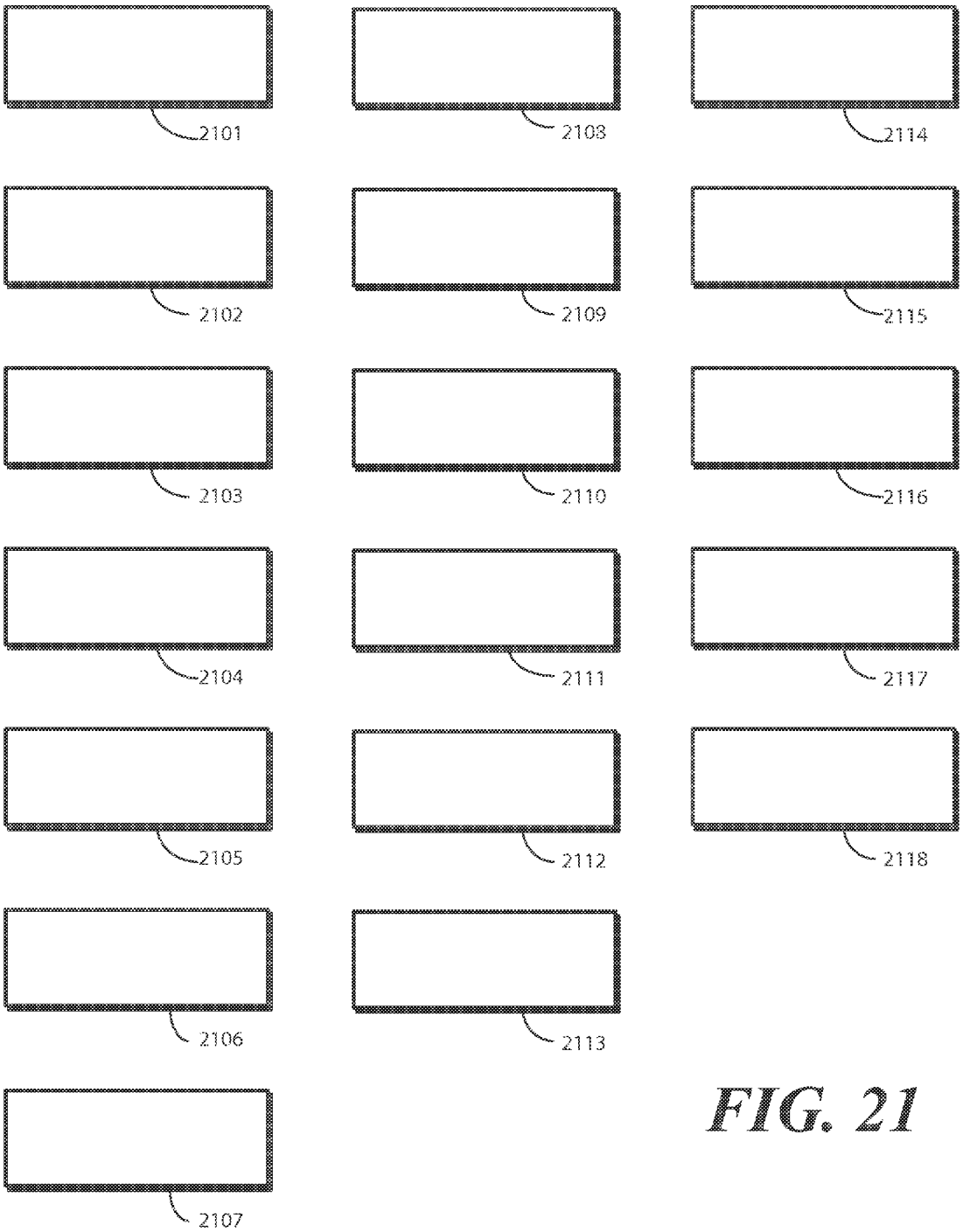
FIG. 21 illustrates various embodiments of the disclosure.

Turning now to FIG. 21, illustrated therein are various embodiments of the disclosure. 1. At 2101, an apparatus comprises a hanger for an item. At 2101 the hanger defines an aperture. At 2101, the aperture comprises a split rotated concave cardioid upper contour. At 2101, the split rotated concave cardioid upper contour comprises a first portion and a second portion. At 2101, the first portion and the second portion are separated by an inverted convex cardioid. At 2101, the inverted convex cardioid is suspended into the aperture by two concave sidewalls. At 2101, the aperture also includes an intersecting concave lower contour. At 2101, the intersecting concave lower contour comprises a cusp.

At 2102, the hanger of 2101 is to fold along a fold line running from a center of the inverted convex cardioid to the cusp. At 2103, the apparatus of 2101 further comprises stitching disposed along a perimeter of the aperture. At 2104, the apparatus of 2012 further comprises a rigid reinforcing device disposed about at least a portion of the split rotated concave cardioid upper contour.

At 2105, the item hanging from the hanger comprises a curtain extending distally from a cusp side of the hanger. At 2106, the curtain of 2105 comprises a porous mesh section. At 2106, the curtain of 2105 comprises an opaque section. At 2106, the porous mesh section is disposed between the hanger and the opaque section. At 2107, the porous mesh section of 2106 extends between eighteen and twenty-two inches beneath the hanger.

At 2108, the hanger of 2101 defines a plurality of the apertures. At 2109, each aperture of 2108 is separated between ten and fifteen inches. At 2109, the split rotated concave cardioid upper contour of 2101 defines two upper lobes. At 2110, each upper lobe comprises a contour complementary to the other lobe.

At 2111, the hanger of 2101 is manufactured from a woven mesh. At 2112, the woven mesh of 2111 is synthetic. At 2113, the woven mesh of 2111 is launderable. At 2114, the woven mesh of 2111 is three inches wide.

At 2115, a system comprises a hanging apparatus. At 2115, the hanging apparatus comprises a hanger and a hanging item extending distally from the hanger. At 2115, the hanger of 2101 defines a plurality of apertures. At 2115, each aperture comprises a split rotated concave cardioid upper contour bisected by an inverted convex cardioid suspended into the aperture. At 2115, each aperture comprises a lower contour comprising a cusp. At 2115, the system also comprises a track. At 2115, the apertures to fold along the inverted convex cardioid to form a folded hanger. At 2115, the track is to fit within upper lobes of the folded hanger defined by the split rotated concave cardioid upper contour.

At 2116, the track of 2115 is flexible. At 2117, the track of 2116 is plastic. At 2118, the system of 2118 further comprises a track hanger to suspend the track from a surface.

Embodiments of the disclosure provide numerous advantages over prior art designs that include metal or plastic rings. These advantages include quieter movement due to the use of mesh hangers and plastic tracks in some embodiments. Additionally, the mesh hangers provide increased durability when subjected to machine-washing processes. Further, mesh hangers do not break as do rigid plastic rings. Another advantage offered by embodiments of the disclosure is the reduced labor cost associated with mounting and dismounting hanging items. Embodiments of the disclosure are lighter in weight, which results in easier assembly, lower manufacturing costs, and lowered shipping cost. Further, when the track is configured to be bendable, fewer components are required to create complex track designs.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. An apparatus, comprising:

a hanger for an item, the hanger defining an aperture comprising:

a split rotated concave cardioid upper contour, the split rotated concave cardioid upper contour comprising a first portion and a second portion;

the first portion and the second portion separated by an inverted convex cardioid suspended into the aperture by two concave sidewalls; and intersecting first and second concave side lower contours joined at a cusp;

each of the two concave side walls joined to respective convex lower portions that are closer to respective ones of the first and second concave lower contours than are the concave side walls;

the hanger comprising material surrounding the aperture.

2. The apparatus of claim 1, the hanger to fold along a fold line running from a center of the inverted convex cardioid to the cusp.

3. The apparatus of claim 2, further comprising stitching disposed along a perimeter of the aperture.

4. The apparatus of claim 2, further comprising a rigid reinforcing device disposed about at least a portion of the split rotated concave cardioid upper contour.

5. The apparatus of claim 1, the item comprising a curtain extending distally from a cusp side of the hanger.

6. The apparatus of claim 5, the curtain comprising a porous mesh section and an opaque section, the porous mesh section disposed between the hanger and the opaque section.

7. The apparatus of claim 6, the porous mesh section extending between eighteen and twenty-two inches beneath the hanger.

8. The apparatus of claim 1, the hanger defining a plurality of apertures, the hanger folded in an accordion fold.

9. The apparatus of claim 8, the accordion fold compressed such that the each aperture touches the next adjacent aperture.

10. The apparatus of claim 1, the split rotated concave cardioid upper contour defining two upper lobes, each upper lobe comprising a contour complementary to an other upper lobe.

11. The apparatus of claim 1, the hanger manufactured from a woven mesh.

12. The apparatus of claim 11, the woven mesh comprises synthetic woven mesh.

13. The apparatus of claim 11, the woven mesh is launderable.

14. The apparatus of claim 11, the woven mesh is three inches wide.

15. A system, comprising:

a hanging apparatus comprising a hanger and a hanging item extending distally from the hanger, the hanger defining a plurality of apertures, each aperture surrounded by hanger material and comprising:

a split rotated concave cardioid upper contour bisected by an inverted convex cardioid suspended into the aperture by two concave sidewalls; and intersecting first and second concave side lower contours joined at a cusp;

each of the two concave side walls joined to respective convex lower portions that are closer to respective ones of the first and second concave lower contours than are the concave side walls; and a track;

each aperture of the plurality of apertures to fold along the inverted convex cardioid to form a folded hanger;

the track to fit within upper lobes of the folded hanger defined by the split rotated concave cardioid upper contour.

16. The system of claim 15, the track flexible.

17. The system of claim 16, the track plastic.

18. The system of claim 15, further comprising a track hanger to suspend the track from a surface.

19. A method, comprising:

providing a hanger for an item by placing apertures in the hanger, each aperture surrounded by hanger material and comprising a split rotated concave upper cardioid contour bisected by an inverted convex cardioid extending into the aperture between by two concave sidewalls of the split rotated concave upper cardioid contour, intersecting first and second concave side lower contours of the aperture joined at a cusp; and each of the two concave side walls joined to respective convex lower portions that are closer to respective ones of the first and second concave lower contours than are the concave side walls; and providing the item attached to the hanger.

20. The method of claim 19, further comprising:

folding the each aperture along a fold line bisecting the each aperture; and hanging the item on a track by placing the track into lobes formed by the split rotated concave upper cardioid contour.

* * * * *